US011045934B1

(12) United States Patent
Hunter

(10) Patent No.: US 11,045,934 B1
(45) Date of Patent: Jun. 29, 2021

(54) HYDRAULIC PANCAKE JACK

(71) Applicant: Jacob Hunter, Elk City, OK (US)

(72) Inventor: Jacob Hunter, Elk City, OK (US)

( * ) Notice: Subject to any disclaimer, the term of this patent is extended or adjusted under 35 U.S.C. 154(b) by 275 days.

(21) Appl. No.: 16/378,798

(22) Filed: Apr. 9, 2019

Related U.S. Application Data

(60) Provisional application No. 62/656,880, filed on Apr. 12, 2018.

(51) Int. Cl.
*B66F 3/24* (2006.01)
*B25B 27/06* (2006.01)

(52) U.S. Cl.
CPC ..... *B25B 27/064* (2013.01)

(58) Field of Classification Search
CPC ..... B66F 1/00; B66F 1/06; B66F 1/08; B66F 3/00; B66F 3/10; B66F 5/00; B66F 5/04
See application file for complete search history.

(56) References Cited

U.S. PATENT DOCUMENTS

2008/0048159 A1* 2/2008 Dai ..... B66F 3/25 254/93 H
2015/0137056 A1* 5/2015 Yang ..... B66F 3/26 254/93 R

* cited by examiner

*Primary Examiner* — Lee D Wilson
(74) *Attorney, Agent, or Firm* — Phillips Murrah PC; Martin G. Ozinga

(57) ABSTRACT

The present invention provides an apparatus, system and method for replacing seats utilizing a hydraulic pancake jack that may be utilized with a valve seat puller, which may include an air return system and or a spring return system.

5 Claims, 4 Drawing Sheets

HYDRAULIC PANCAKE JACK

CROSS-REFERENCE TO RELATED APPLICATIONS

Priority is claimed from provisional patent application U.S. Ser. No. 62/656,880 filed on Apr. 12, 2018, and incorporated by reference herein.

BACKGROUND OF THE INVENTION

1. Field of the Invention

In general, the present invention relates to an apparatus and system for a hydraulic pancake jack. More particularly, the present invention provides an improved jack that may be utilized to remove valve seats, pump liners and so forth from oilfield fracturing pumps, mud pumps, nitrogen pumps, and other equipment found in the oil and gas industry as well as other equipment utilizing same. It is also understood the current invention may be utilized in any other pump type that utilizes replaceable open face seats.

2. Description of the Prior Art

It is understood that in various piston type reciprocating pumps there are valves, which open and close in order to direct the flow. The valve mates to a replaceable seat in order to create a seal, stopping the fluid, which is being pumped, moving in the direction it is being forced. Over time with the opening and closing of the valves against seat creates wear causing the valves not to seal. The common term used for worn seats is "washed". At this time, the seats must be replaced with new ones.

Valve seats in most pumps are generally slightly tapered, with or without an O-ring, for sealing the seat to the pump head. They are typically held in place by the taper, in that they are pressed into place. When a seat is replaced, it is removed with a puller. There are several different types of pullers used, which include a two half puller that spreads out to the inside dimension of the seat by threading the puller shaft inside it, opening the two outer halves far enough to catch the bottom of the seat. This is typically done by two people where one lowers the puller shaft down through the seat, while another person reaches the two half parts of the puller through an open port in the head. The person with the threaded shaft then attempts to thread the puller shaft into the expandable halves. A hydraulic jack, such as hollow shaft jack, is then generally utilized to pull the shaft.

Due to the nature of seats in general, it is often extremely difficult to remove the seat after it is installed. It is not unusual for the down time in removing a valve seat with prior art devices to run 8-20 hours. There are many prior art devices for pulling pump valve seats and liners, but most of them are complex and expensive.

Therefore, it is desirable to provide a jack to be utilized in conjunction with valve seat puller and or extractor that may easily be affixed to the puller, be light enough for one person to handle, and provide a high pull weight.

Present day drilling operations are extremely expensive, and an effort to increase the overall efficiency of the drilling operation while minimizing expense requires the essentially continuous operation of the drilling rig. Thus, it is imperative that downtime be minimized. The above discussed limitations in the prior art is not exhaustive. Thus, there is a need for an apparatus, method and system to remove valve seats, pump liners, and so forth easily and quickly. The current invention provides an inexpensive, time saving, more reliable apparatus and system where the prior art fails.

SUMMARY OF THE INVENTION

In view of the foregoing disadvantages inherent in the known types of jacks now present in the prior art, the present invention provides a new and improved apparatus and system, which is easier to utilize and more time efficient. As such, the general purpose of the present invention, which will be described subsequently in greater detail, is to provide a new and improved jack apparatus and system for replacing seats, which has all the advantages of the prior art devices and none or fewer of the disadvantages.

To attain this, the present invention essentially comprises a new and improved pancake jack that provides sufficient strength for forces required to pull out the seat, pump liner and so forth and may comprise a through hole for placing a puller, be able to create a pulling force of over 200 tons, be made of aluminum, retract automatically, and so forth that may be utilized for removing various seats, valve seats, pump liners and so forth from oilfield fracturing pumps, mud pumps, nitrogen pumps, and other equipment found in oil and gas industry as well as other equipment utilizing same. The invention may also include a jack puller system comprising a jack and puller.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved jack apparatus, system and method for removing and or pulling seats, pump liners, and so forth, which may be easily and efficiently utilized.

It is a further object of the present invention to provide a new and improved jack apparatus, system and method for removing seats, pump liners, and so forth, which is of a durable and reliable construction and may be utilized with multiple types of applications in the oil and gas field as well as other applications.

An even further object of the present invention is to provide a new and improved jack apparatus, system and method for removing seats, pump liners, and so forth, which is generally susceptible to a low cost of manufacture with regard to both materials and labor, and which accordingly is then susceptible to low prices of sale to the consuming industry, thereby making such tool economically available to those in the field.

Still another object of the present invention is to provide a new and improved jack apparatus, system and method for removing seats, pump liners, and so forth, which provides all of the advantages of the prior art, while simultaneously overcoming some of the disadvantages normally associated therewith.

Another object of the present invention is to provide a new and improved jack apparatus, system and method for removing seats, pump liners, and so forth that is light weight and easily handled by one person such as but not limited to making the jack from aluminum and providing handles.

Yet another object of the present invention is to provide a new and improved jack apparatus, system and method for removing seats, pump liners, and so forth that limits the length of the usable stroke as well as retracts automatically.

Still another object of the present invention is to provide a new and improved jack apparatus, system and method for removing seats, pump liners, and so forth, which increases the speed of the replacement operation regarding changing out of associated parts.

An even further object of the present invention is to provide a new and improved jack apparatus, system and method for removing seats, pump liners, and so forth that provides a robust device capable of extreme and numerous uses and may generally withstand much greater amounts of pressure than existing jacks known in the art.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings, and appendices.

DETAILED DESCRIPTION OF THE PREFERRED EMBODIMENTS

Figure 1:
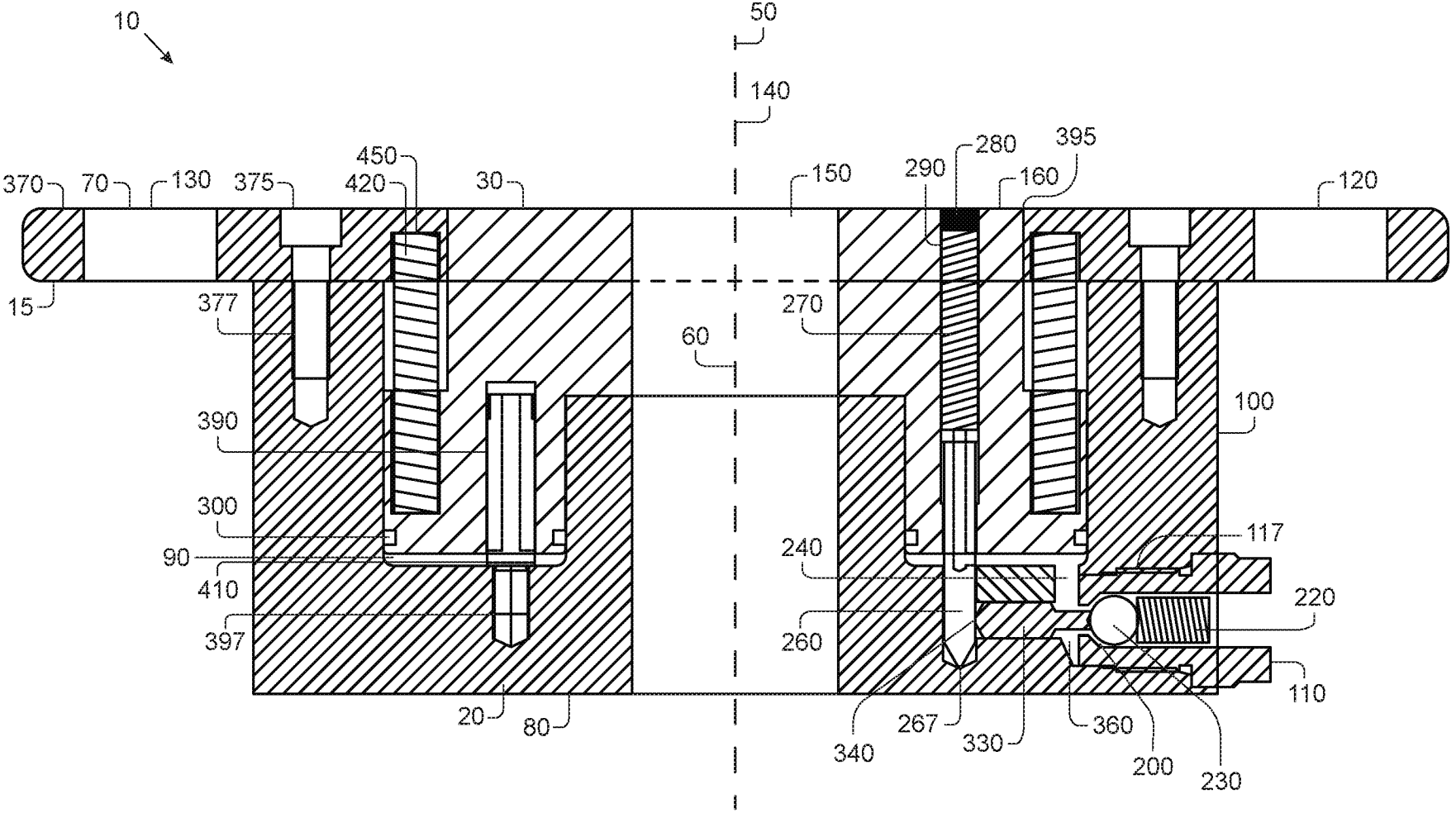
FIG. 1 is generally a depiction of a cross section of preferred embodiment of the invention generally showing a piston collapsed and or first position and utilized with a spring return system in accordance with the current invention.

Referring to the illustrations, drawings, and pictures, reference character 10 generally designates a new and improved jack and or jack puller device, assembly, system and method of using same constructed in accordance with the present invention. Invention 10 is generally used in oil and gas well operations but may be utilized in other applications. The current invention should not be considered limited to just seat, valve seat, pump liners, and so forth removal.

Figure 2:
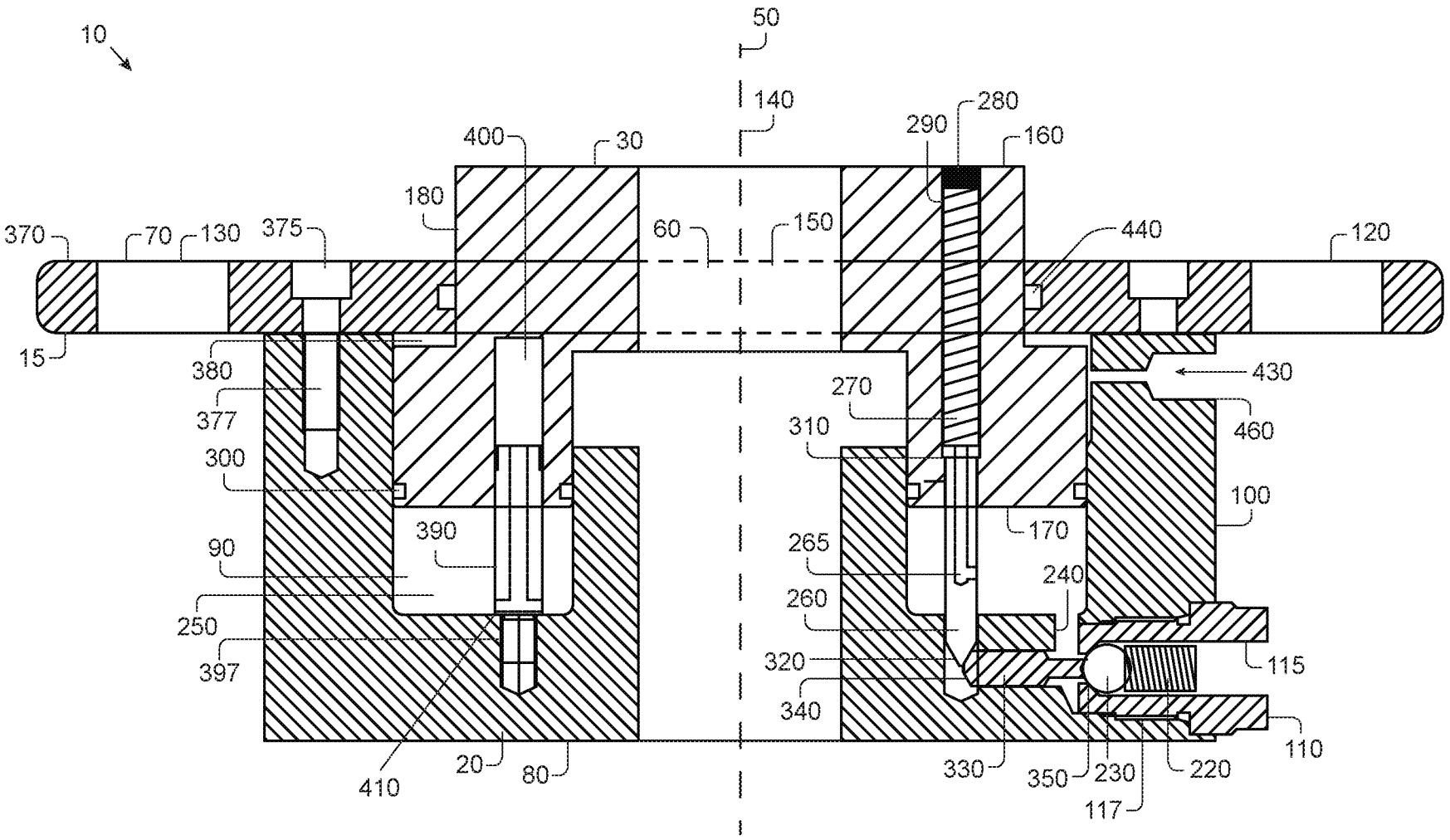
FIG. 2 is generally a depiction of a cross section of preferred embodiment of the invention generally showing a piston extended and or second position and utilized with an air return system in accordance with the current invention.

Now referring to the illustrations and more in particular to FIGS. 1 and 2, invention 10 may include a jack 15 having a housing 20, a piston 30 disposed therein, and a hydraulic system 40 for moving piston 30 within housing 20. It is contemplated that invention 10 may be made from mainly aircraft aluminum to be approximately 50% lighter than standard steel constructed jacks such as but not limited to modern alloys with high yield strengths such as 7075-T6511, 7050-T6511 and others of similar characteristics. It is contemplated that jack 15 may be 35 or 40 pounds but it is understood that more or less weight is contemplated. The weight is an issue such that the prior art devices are too heavy for one person to operate whereas the current invention may be handled and or utilized by one person.

Housing 20 may include central axis 50, an aperture 60, a top 70, a bottom 80, an interior 90, an exterior 100, and a port 110 from exterior 100 to interior 90 for passing hydraulic fluid. Port 110 may have a threaded interior 115 for connection known in the prior art. Port 110 may include a threaded exterior 117 for placing in housing 20.

Housing may also include a first handle 120 and a second handle 130. It is understood that shapes, sizes, number and or locations of same should not be considered limited by the illustrations.

Piston 30 may have a central axis 140, an aperture 150, a top 160, a bottom 170, and an exterior 180. It is contemplated that piston 30 may have but is not limited to a 1 inch stroke. Stroke may be defined as the amount of movement upward of piston 30 from housing 20. Piston 30 is generally positioned to sit in interior 90 of housing 20 and hydraulically moved upward as desired.

Hydraulic system 40 may include a power source and or pump 190 of hydraulic fluid and or fluid 200 that may communicate with housing 20 port 110 via conduit 210. It is understood that piston 30 is moved upward when hydraulic pressure is applied to bottom 170 of piston 30 and may lower when hydraulic pressure is decreased. Upon hydraulic pressure being applied to housing 20 by pump 190 through port 110, fluid 200 travels past spring 220 and ball 230 up through port 240 into piston cavity 250. When pressurized volume increases, piston 30 is forced upward as piston cavity 250 is increased by fluid volume. As piston 30 rises, valve pin 260 is held in place from traveling with piston 30 by spring 220. Spring 270 is retained inside of piston 30 by plug 280, which is threaded into piston 30 through spring 270 cavity 290. Fluid 200 is held from leaking past piston 30 by seals 300 located on outer and inner circumference of piston 30. As piston 30 continues to rise, the shoulder on valve pin 260 contacts shoulder 310 inside spring 270 cavity 290, and begins to travel upward with piston 30.

Valve pin 260 may include flow port 265 and have a stopping point 267. As piston 30 travels upward, towing valve pin 260 with it, tapered end 320 of valve pin 260 moves upward, out of valve pin cavity 340, which allows spring 220 to move ball 230 to coincide plunger 330, forcing plunger 330 to travel into valve pin cavity 340, allowing ball 230 to rest on seat 350, thus stopping fluid 200 flow into piston cavity 250 through port 240. At this point, all fluid 200 pressure coming from pump 190 is halted at valve 360, leaving only the pressure required to move piston 30, to its current raised position, in the piston cavity 250.

Manufacturing specifications set the length of the tapered end 320 of valve pin 260 so that piston 30 does not rise to contact top cover 370 when ball 230 engages seat 350 and stops fluid 200 flow, but rather leaves a gap 380 between piston 30 and top cover 370. To ensure that valve pin 260 remains aligned with plunger 330, guide pin 390 has been added, which mates to a guide pin mating bore 400 in piston 30 to ensure that piston 30 may not rotate out of alignment. Further guide pin 390 may have a relief hole 410 drilled through the side and top, to allow displacement of fluid 200 as the piston 30 is actuated in both directions. Guide pin 390 may also have threads 397 for securing to housing 20.

Top cover 370 may use bolt(s) 375 and threaded engagement 377 in housing 20. It is contemplated to provide gap 395 between valve pin 260 and top cover 370. It is understood that numerous securing methods as known in the art are contemplated.

There are two types of automatic piston 30 return systems to be described. The first is a spring return system 450 as shown in FIG. 1 that allows the piston 30 to collapse back into housing 40 via spring bias. The second is an air return system 460 as shown in FIG. 2 that pushes piston 30 back into housing 20.

Spring Return System 450

As the piston 30 rises, it compresses return spring 420 between piston 30 and top cover 370. Once inlet flow is released at the pump 190, return spring 420 forces piston 30 down, forcing fluid 200 through port 240, causing ball 230 to compress valve spring 220 and allow fluid 200 to escape past seat 350. As piston 30 continues to travel to its collapsed position, valve pin 260 engages plunger 330, forcing it to push ball 230 away from valve seat 350, opening passage for fluid 200, allowing fluid to return to pump 190 until piston 30 is fully retracted, as it is pictured in FIG. 1. The assembly is now ready to be used to pull remaining seats.

Air Return System 460

As many companies are now using air operated pumps instead of hand operated manual pumps to actuate hydraulic jacks, invention 10 contemplates an air return system 460 as generally depicted in FIG. 2. It is contemplated to use the already present air supply to retract the jack 15 piston 30. After the pump 190 has extended the piston 30, it is retracted by air pressure applied to the remaining gap 380 between the piston 30 and the top cover 370, through the air inlet and or port 430. Standard air pressure, from the air supply 435 that is used to operate the pneumatic hydraulic pump 190, is hooked to the jack 15 air inlet and or port 430 via common air hose, creating a degree of downward force on the piston 30. The downward force is calculated by the amount area on top of the piston under the top cover 370. This creates very little resistance in comparison to the lift capacity of the invention, but enough to compress the jack 15 once the pump 190 return valve has been opened, allowing the hydraulic fluid 200 to return out of the housing 20, to the pump 190. The air is contained inside the housing 20 by the lower hydraulic seals 300 on the piston 30, and by top cover seal 440 located on the inner diameter of the top cover 370. In this case, the air from the air supply which may be between 125 psi and 175 psi creates a "spring" effect inside the upper piston 30 portion.

Operation

Figure 3B:
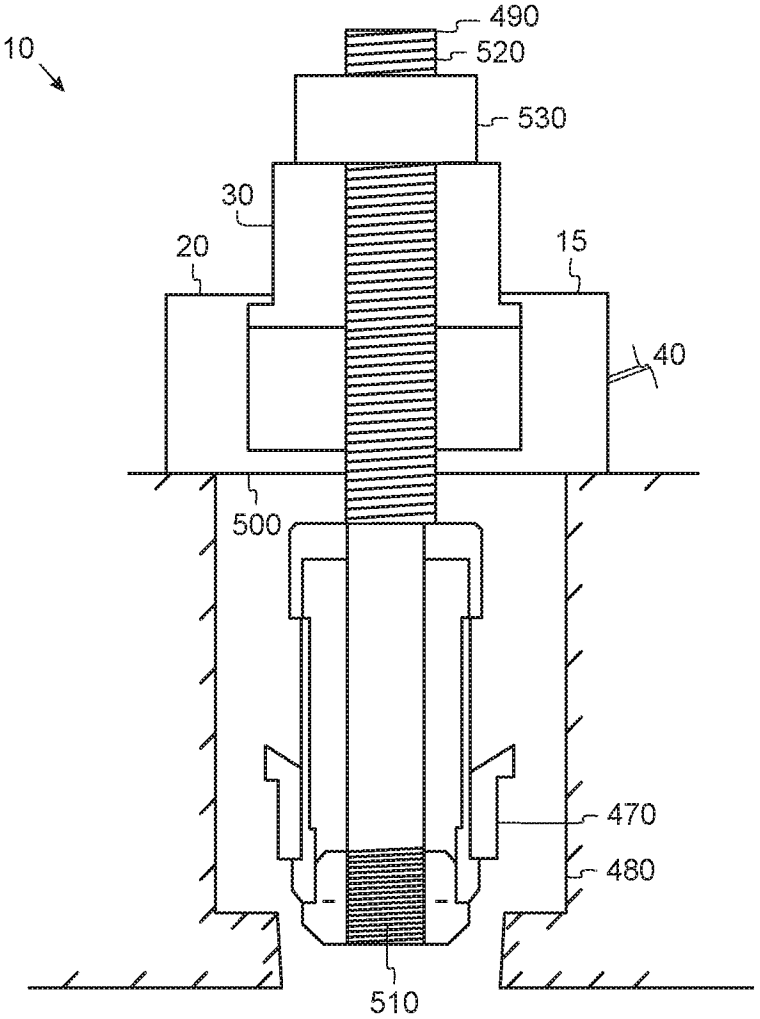
FIG. 3B is generally a preferred embodiment depicting a puller after it has passed completely through valve seat and in communication and after a jack has lifted and removed seat in accordance with the current invention.
Figure 3A:
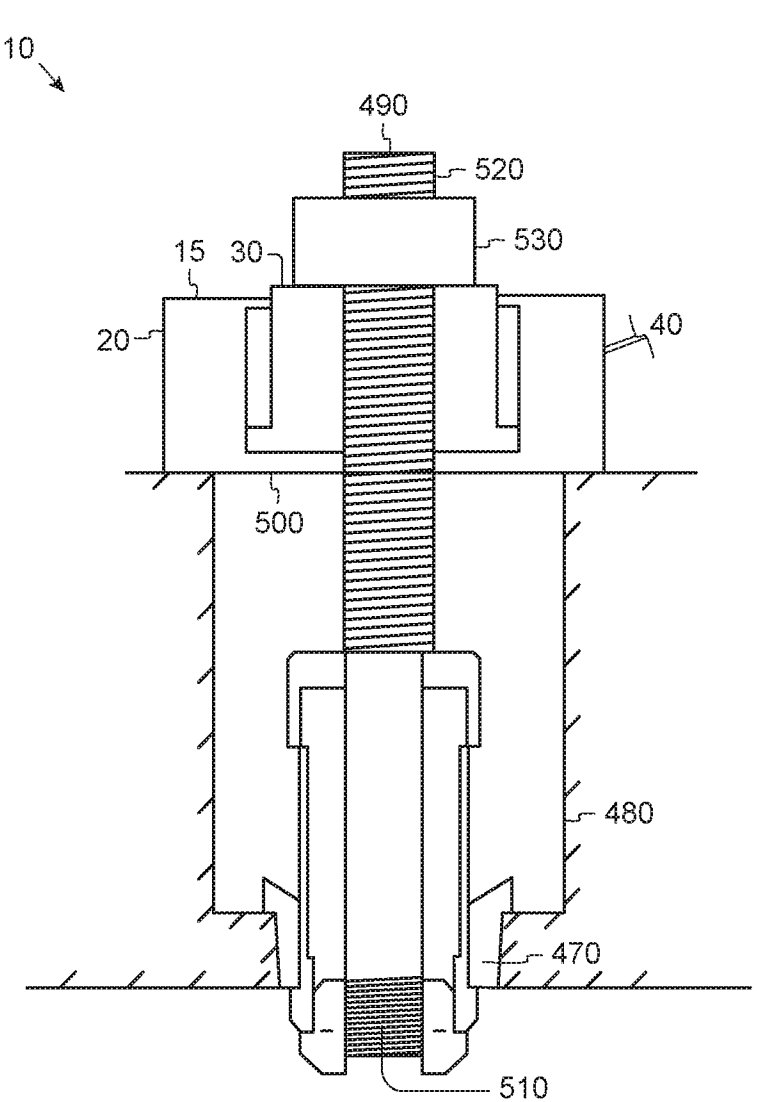
FIG. 3A is generally a preferred embodiment of the invention depicting a puller after it has passed completely through valve seat and in communication with a jack for lifting to remove valve seat in accordance with the current invention.
Figure 5:
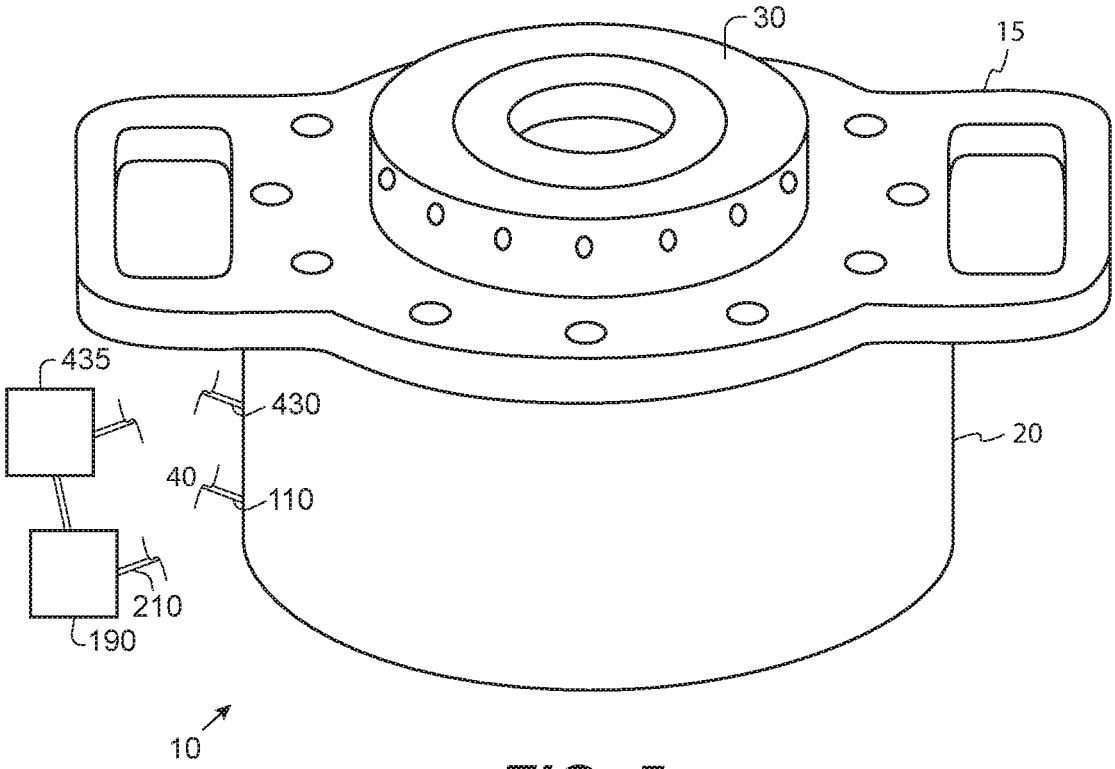
FIG. 5 is generally a perspective view of a preferred embodiment with the piston extended in accordance with the current invention.

Referring now again to the figures and more in particular to FIGS. 3A and 3B, when removing seat 470 from a pump 480, a puller 490 is inserted into the discharge access hole 500 in the top of the fluid end. After puller 490 shaft bottom and or bottom end 510 is engaged in seat 470 to be pulled, jack 15 can be installed over the puller 490 through apertures 150 in piston 30 in the center of jack 15. On drilling style mud pumps it is often necessary to use a large spacer or "H" block between the fluid end and jack 15, for proper surface area contact with jack 15, as some fluid ends have a bolt on flange on top of the fluid end. Once jack 15 is installed onto the puller 490 shaft top 520, a nut 530 is threaded onto the puller 490 second end and or shaft top 520, and secured against the top 160 of piston 30. Seat 470 is now ready for removal as piston 30 travels upward from housing 20 as depicted generally in FIG. 5.

Figure 4:
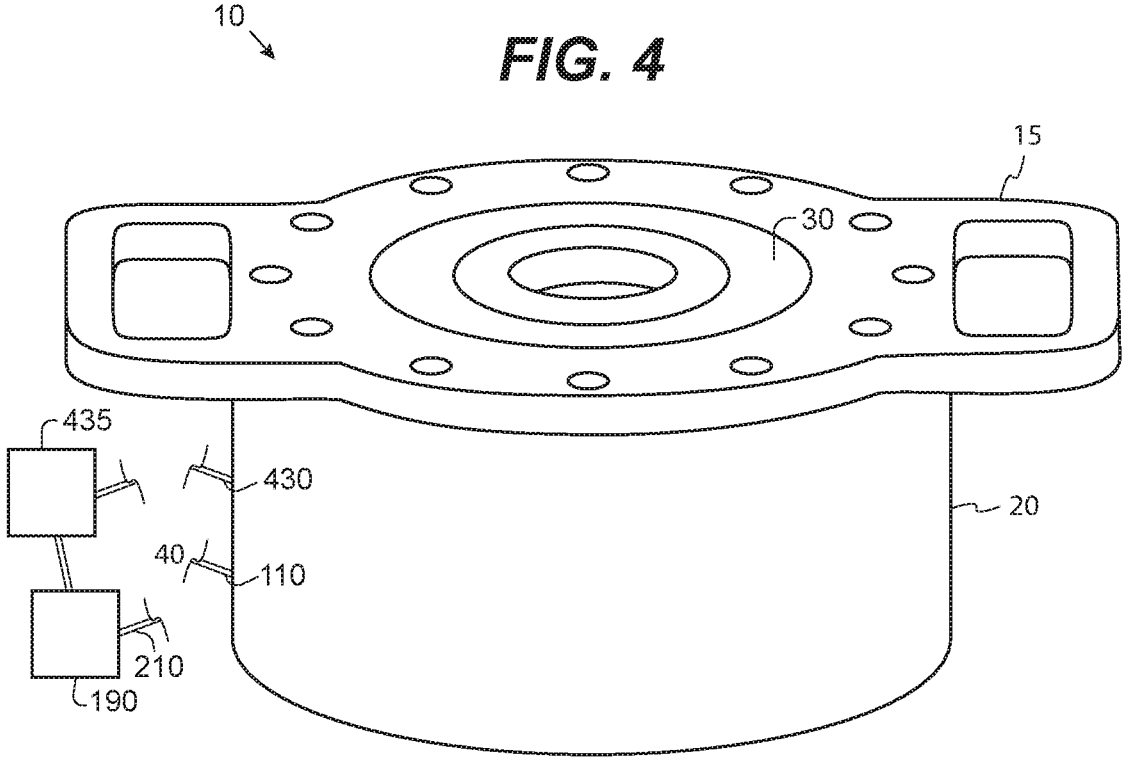
FIG. 4 is generally a perspective view of a preferred embodiment with the piston collapsed in accordance with the current invention.

After seat 470 removal, piston may be returned to original and or collapsed position as depicted in FIG. 4. This may be accomplished by spring return system 450, air return system 460, and or combinations thereof. It is contemplated that invention 10 may withstand the high hydraulic pressures required of 10,000 psi operating pressure and a range in excess of 200 tons.

It is therefore contemplated to provide a jack puller system to remove valve seats or pump liners comprising a housing having a top, a bottom, an aperture extending between said top and said bottom having an axis perpendicular to said top and said bottom, a port into said housing to a cavity contained inside said housing for hydraulic fluid operations; a piston having a top, a bottom, an aperture extending between said top and said bottom having an axis perpendicular to said top and said bottom wherein said piston is adapted to fit inside said cavity of said housing, said axis of said piston is aligned with said axis of said housing; wherein said piston has a first position wherein said top of said piston is flush with said top of said housing and wherein said piston has a second position wherein in said top of said piston is pushed above said top of said housing; a hydraulic system having a pump to selectively provide and remove said hydraulic fluid to said cavity of said housing via said port below said bottom of said piston wherein said piston is moved from said first position to said second position by said hydraulic system; a return system for automatically moving said piston from said second position to said first position; and a puller having a bottom end for removably inserting through said aperture of said piston and adapted to engage said valve seat or said pump liner for removal, and a second end adapted to be removably attached to said top of said piston.

It is also contemplated said housing and said piston combined weight is under 50 pounds, wherein said return system includes a spring biased to push said piston down when said hydraulic fluid is removed from said cavity via said port and said hydraulic system, wherein said housing includes an air inlet adapted to provide air to said return system to push said piston down when said hydraulic fluid is removed from said cavity via said port and said hydraulic system; and wherein said jack puller system is adapted to provide a pulling force of over 200 tons.

Changes may be made in the combinations, operations, and arrangements of the various parts and elements described herein without departing from the spirit and scope of the invention. Furthermore, names, titles, headings and general division of the aforementioned are provided for convenience and should, therefore, not be considered limiting.

What is claimed is:

1. A jack puller system to remove valve seats or pump liners comprising:

a housing having a top, a bottom, an aperture extending between said top and said bottom having an axis perpendicular to said top and said bottom, a port into said housing to a cavity contained inside said housing for hydraulic fluid operations;

a piston having a top, a bottom, an aperture extending between said top and said bottom having an axis perpendicular to said top and said bottom wherein said piston is adapted to fit inside said cavity of said housing, said axis of said piston is aligned with said axis of said housing;

wherein said piston has a first position wherein said top of said piston is flush with said top of said housing and wherein said piston has a second position wherein in said top of said piston is pushed above said top of said housing;

a hydraulic system having a pump to selectively provide and remove said hydraulic fluid to said cavity of said housing via said port below said bottom of said piston wherein said piston is moved from said first position to said second position by said hydraulic system;

a return system for automatically moving said piston from said second position to said first position; and a puller having a bottom end for removably inserting through said aperture of said piston and adapted to engage said valve seat or said pump liner for removal, and a second end adapted to be removably attached to said top of said piston.

2. The jack puller system of claim 1 wherein said housing and said piston combined weight is under 50 pounds.

3. The jack puller system of claim 1 wherein said return system includes a spring biased to push said piston down when said hydraulic fluid is removed from said cavity via said port and said hydraulic system.

4. The jack puller system of claim 1 wherein said housing includes an air inlet adapted to provide air to said return system to push said piston down when said hydraulic fluid is removed from said cavity via said port and said hydraulic system.

5. The jack puller system of claim 1 wherein said jack puller system is adapted to provide a pulling force of over 200 tons.

* * * * *